United States Patent [19]

Blanchard

[11] Patent Number: 4,755,155

[45] Date of Patent: Jul. 5, 1988

[54] MARINE PROPULSION DEVICE OIL COOLING KINGPIN ARRANGEMENT

[75] Inventor: Clarence E. Blanchard, Kenosha, Wis.

[73] Assignee: Outboard Marine Corporation, Waukegan, Ill.

[21] Appl. No.: 21,360

[22] Filed: Mar. 3, 1987

[51] Int. Cl.[4] ..... B63H 21/38

[52] U.S. Cl. ..... 440/53; 440/88; 123/196 AB

[58] Field of Search ..... 440/88, 89, 53; 123/196 AB

[56] References Cited

U.S. PATENT DOCUMENTS

| | | | |
|---|---|---|---|
| 1,822,573 | 9/1931 | Fitz Gerald et al. . | |
| 1,824,735 | 9/1931 | Johnson . | |
| 2,212,250 | 8/1940 | Schutt | 237/12.3 |
| 2,224,900 | 12/1940 | Conover | 440/88 |
| 2,496,434 | 2/1950 | Bosma | 184/6 |
| 2,549,479 | 4/1951 | Kiekhaefer | 115/17 |
| 2,637,173 | 5/1953 | Taylor | 62/1 |
| 2,644,434 | 7/1953 | Watkins | 121/41.47 |
| 2,660,410 | 11/1953 | Hofmeister | 257/230 |
| 2,888,251 | 5/1959 | Dalin | 257/235 |
| 2,898,896 | 8/1959 | McKinney | 123/41 |
| 2,969,763 | 1/1961 | Foster | 115/18 |
| 3,234,884 | 2/1966 | Gearn | 103/54 |
| 3,353,590 | 11/1967 | Holman | 165/35 |
| 3,380,443 | 4/1968 | Tado | 123/196 |
| 3,493,081 | 2/1970 | Tado | 184/104 |
| 3,750,614 | 8/1973 | Giacosa | 115/17 |
| 3,799,291 | 3/1974 | Becker | 184/6.18 |
| 3,990,424 | 11/1976 | Miersch et al. | 123/196 |
| 4,167,969 | 9/1979 | Ritzenthaler | 165/51 |
| 4,442,819 | 4/1984 | Veach | 123/557 |
| 4,641,615 | 2/1987 | Ferguson | 123/196 |

FOREIGN PATENT DOCUMENTS

| | | | |
|---|---|---|---|
| 188789 | 11/1983 | Japan | 440/88 |

*Primary Examiner*—Joseph F. Peters, Jr.
*Assistant Examiner*—Stephen P. Avila
*Attorney, Agent, or Firm*—Michael, Best & Friedrich

[57] ABSTRACT

A marine propulsion device comprising a power head having an engine, a lower unit which carries the engine, the lower unit including a rotatably mounted propeller and a drive shaft housed within the lower unit and operatively coupled to the engine and to the propeller, a swivel bracket adapted for mounting to a transom bracket for affording vertical tilting movement of the swivel bracket about a generally horizontal axis, the swivel bracket having a generally vertical bore, and a tubular pivot shaft connected to the lower unit and supported within the vertical bore for rotation about a generally vertical steering axis, and including therein a fluid passage adapted to communicate with a source of fluid to be cooled, and a water passage located adjacent the fluid passage and adapted to communicate with a flow of water to cool the fluid in the passage. Preferably, the lower unit includes a water inlet connected to a water entry conduit, and a water outlet connected to a water exit conduit, and the tubular pivot shaft water passage is located adjacent the fluid passage and communicates with the lower unit water entry and exit conduits so that forward motion of the lower unit results in a flow of water through the water passage to cool the fluid in the fluid passage.

16 Claims, 1 Drawing Sheet

50
90
84
92
82
85
92
80
62
38
60

38
24
58
106
56
20
102
18
104
52
90
100
54
98
50
94
14
85
92
3
3
80
60
84
90
62
82
63
74
75
86
51
61
53

30
40
38
44
42
10
12
58
20
54
18
26
24
22
36
14
16
75
76
78
61
63
70
55
44
72
28

MARINE PROPULSION DEVICE OIL COOLING KINGPIN ARRANGEMENT

BACKGROUND OF THE INVENTION

The invention relates to oil cooling arrangements, and more particularly to hydraulic oil cooling arrangements in marine propulsion devices.

As disclosed in U.S. Pat. No. 4,167,969 to Ritzenthaler, it known to insert a transmission oil cooler into a hose of an engine cooling system.

It is also know to use a water jacket for cooling a lubricating oil pump, as disclosed in U.S. Pat. Nos. 3,493,081 and 3,380,443 to Tado, and to exteriorly add a heat exchanger to an engine water jacket, as disclosed in U.S. Pat. No. 2,898,896 to McKinney.

It is also known to insert a fluid cooler into an opening in a cooling water jacket of an engine as is discussed in U.S. Pat. No. 4,641,615 to Fergusen issued Feb. 10, 1987.

As discussed in U.S. Pat No. 2,969,763 to Foster, it known to use a kingpin as an oil filling tube and for measuring the oil level in an oil reservoir in the lower unit of the drive shaft of the marine propulsion device.

As disclosed in U.S. Pat. No. 2,549,479 to Kiekhaefer it is known to provide for a coolant water discharge line through a portion of a forwardly located kingpin of a marine propulsion device.

Attention is also directed to the following U.S. Pat. Nos.:

Gerald: U.S. Pat. No. 1,822,573 Sept. 8, 1931
Johnson: U.S. Pat. No. 1,824,735 Sept. 22, 1931
Johnson: U.S. Pat. No. 1,824,737 Sept. 22, 1931
Schutt: U.S. Pat. No. 2,212,250 Aug. 20, 1940
Bosma: U.S. Pat. No. 2,496,434 Feb. 7. 1950
Watkins: U.S. Pat. No. 2,644,434 July 7, 1953
Dalin: U.S. Pat. No. 2,888,251 May 26, 1959
Gearn: U.S. Pat. No. 3,234,884 Feb. 15, 1966
Holman: U.S. Pat. No. 3,353,590 Nov. 21, 1967
Giacoso: U.S. Pat. No. 3,750,614 Aug. 7, 1973
Becker: U.S. Pat. No. 3,799,291 Mar. 26, 1974
Miersch: U.S. Pat. No. 3,990,424 Nov. 9, 1976
Veach: U.S. Pat. No. 4,442,819 Apr. 17, 1984
Hofmeister: U.S. Pat. No. 2,660,410 Nov. 24, 1953
Taylor: U.S. Pat. No. 2,637,173 May 5, 1953

SUMMARY OF THE INVENTION

The invention provides a marine propulsion device comprising a power head having an engine, a lower unit which carries the engine, the lower unit including a rotatably mounted propeller and a drive shaft housed within the lower unit and operatively coupled to the engine and to the propeller, a swivel bracket adapted for mounting to a transom bracket for affording vertical tilting movement of the swivel bracket about a generally horizontal axis, the swivel bracket having a generally vertical bore, and a tubular pivot shaft connected to the lower unit and supported within the vertical bore for rotation about a generally vertical steering axis, and including therein a fluid passage adapted to communicate with a source of fluid to be cooled.

In one embodiment, the tubular pivot shaft also includes therein a water passage located adjacent the fluid passage and adapted to communicate with a flow of water to cool the fluid in the fluid passage.

In one embodiment, the lower unit includes a water entry conduit and a water inlet connected to the water entry conduit, and a water exit conduit and a water outlet connected to the water exit conduit, and the tubular pivot shaft includes therein a water passage located adjacent the fluid passage and communicating with the lower unit water entry and exit conduits so that forward motion of the lower unit results in a flow of water from the water inlet through the water passage and out the water outlet to cool the fluid in the fluid passage. Preferably, the water inlet is located on the leading edge of the lower unit, and the lower unit water outlet is located rearwardly of the water inlet.

In one embodiment, the tubular pivot shaft includes therein a fluid inlet manifold adapted to receive the fluid to be cooled and a fluid outlet manifold adapted to receive the fluid after cooling thereof, and the said fluid passage communicates with the inlet and outlet fluid manifolds. The fluid inlet manifold includes an inlet fitting extending externally of the tubular pivot shaft and adapted for connection to a supply line of fluid to be cooled, and the fluid outlet manifold includes an outlet fitting extending externally of the tubular pivot shaft and adapted for connection to a return line of the fluid to be cooled. Preferably, the inlet and outlet manifolds are located adjacent each other at the upper end of the tubular pivot shaft, and the fluid passage comprises a generally U-shaped tube with a pair of legs and a middle portion which extends toward the opposite end of the tubular pivot shaft.

In one embodiment, the tubular pivot shaft includes therein a baffle which divides the water passage into an inlet water chamber which communicates with the lower unit water entry conduit, and an outlet chamber which communicates with the inlet water chamber and with the lower unit water exit conduit, and one leg of the U-shaped tube extends within the inlet water chamber and the other leg of the U-shaped tube extends within the outlet water chamber, whereby forward motion of the lower unit results in a flow of water serially through the inlet water chamber and the outlet water chamber to cool the fluid in the U-shaped tube. Preferably, the leg of the U-shaped tube extending within the inlet water chamber is connected to the fluid inlet manifold, and the leg of the U-shaped tube contained within the outlet water chamber is connected to the fluid outlet manifold. Also, the baffle and the legs of the U-shaped tube extend within the tubular pivot shaft generally parallel to the axis of the tubular pivot shaft and extend along a major portion of the length of the tubular pivot shaft. Preferably, the fluid passage comprises a plurality of U-shaped tubes each having a pair of legs with one leg communicating with the fluid inlet manifold and extending through the water inlet chamber within the tubular pivot shaft and with the other leg communicating with the fluid outlet manifold and extending through the water outlet chamber of the tubular pivot shaft.

The invention also provides a fluid cooling kingpin assembly adapted for use with amarine propulsion device including a power head having an engine and a lower unit which carries the engine and a rotatably mounted propeller, the assembly comprising a swivel bracket adapted for mounting to a transom bracket for affording vertical tilting movement of the swivel bracket and the lower unit about a generally horizontal axis, the swivel bracket having a generally vertical bore, and a tubular pivot shaft mounted within the vertical bore for rotation and support of the lower unit about a generally vertical steering axis, the tubular pivot shaft including therein a fluid passage adapted to communicate with a source of fluid to be cooled. Preferably, the tubular pivot shaft also includes therein a water passage located adjacent the fluid passage and adapted to communicate with a flow of water to cool the fluid in the fluid passage.

The invention also provides a fluid cooling kingpin adapted for use with a marine propulsion device including a power head having an engine and a lower unit which carries the engine and a rotatably mounted propeller, and a swivel bracket adapted for mounting to a transom bracket for affording vertical tilting movement of the swivel bracket and the lower unit about a generally horizontal axis, the swivel bracket having a generally vertical bore, the fluid cooling kingpin comprising a tubular pivot shaft mounted within the swivel bracket vertical bore for rotation and support of the lower unit about a generally vertical steering axis, the tubular pivot shaft including therein a fluid passage adapted to communicate with a source of fluid to be cooled. Preferably, the tubular pivot shaft also includes therein a water passage located adjacent the fluid passage and adapted to communicate with a flow of water to cool the fluid in the fluid passage.

A principal feature of the invention is the provision of a marine propulsion device including a fluid cooling kingpin assembly comprising a tubular pivot shaft having therein a fluid passage adapted to communicate with a source of fluid to be cooled. Thus, the invention provides an effective space-saving method of cooling oil or hydraulic fluid by using a tubular pivot shaft journaled in the vertical bore of a swivel bracket attached to a boat transom.

Another principal feature of the invention is the provision of such a marine propulsion device wherein the tubular pivot shaft includes therein a water passage located adjacent the fluid passage, the marine propulsion device further comprising a lower unit having a water inlet connected to a water entry conduit and a water outlet connected to a water exit conduit, the conduits communicating with the tubular pivot shaft water passage so that forward motion of the lower unit results in a cooling flow of water through the water passage adjacent the fluid passage within the tubular pivot shaft.

Another principal feature of the invention is the provision of such a marine propulsion device having a tubular pivot shaft with the construction as described above.

Other principal features and advantages of the invention will become apparent to those skilled in the art upon review of the following detailed description, claims and drawings.

Figure 3:
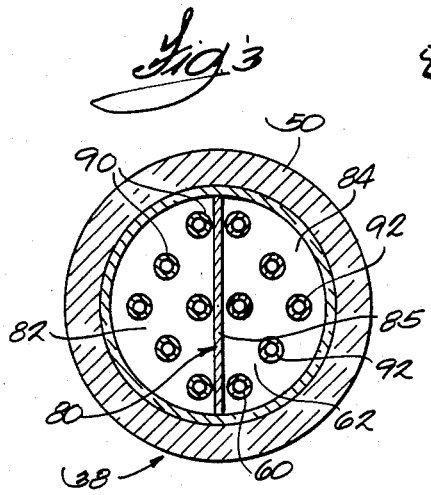
FIG. 3 is a cross-sectional view taken along line 3—3 in FIG. 2.

Before an embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 1:
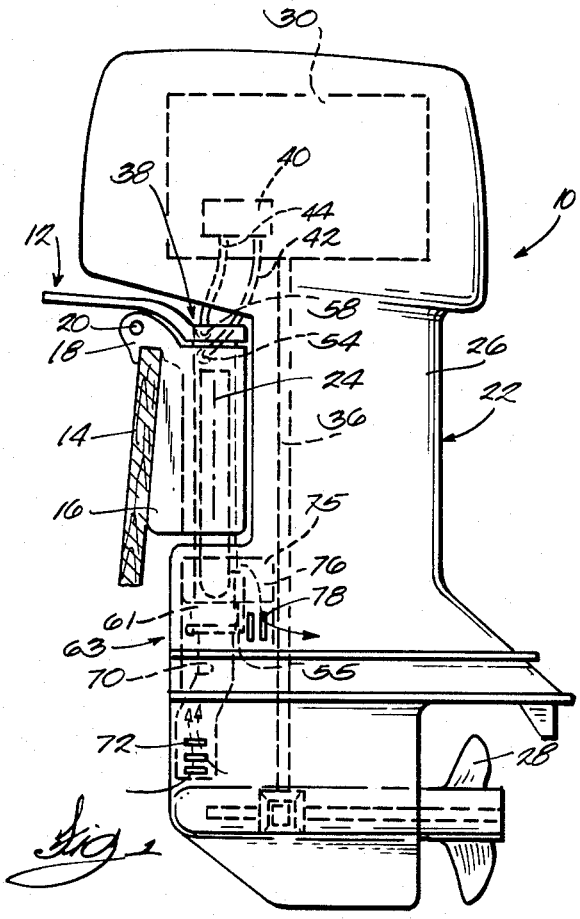
FIG. 1 is a side elevational view of a marine propulsion device embodying the invention.

A marine propulsion device 10 embodying the invention is illustrated in the drawings. As best shown in FIG. 1, the marine propulsion device 10 comprises a mounting assembly 12 fixedly attached to the transom 14 of a boat. In the preferred embodiment, the mounting assembly 12 includes a transom bracket 16 fixedly attached to the transom 14, and a swivel bracket 18 pivotally mounted on the transom bracket 16 for pivotal movement of the swivel bracket 18 relative to the transom 14 about a generally horizontal tilt axis 20.

The marine propulsion device 10 also comprises a propulsion unit 22 pivotally mounted on the swivel bracket 18 for pivotal movement of the propulsion unit 22 relative to the swivel bracket 18 about a generally vertical steering axis 24. The propulsion unit 22 includes a lower unit 26 including a rotatably mounted propeller 28, and an internal combustion engine 30 (diagrammatically shown) mounted on the lower unit 26. In the preferred embodiment, the engine 30 is conventionally connected to the propeller 28 by a drive shaft 36.

Figure 2:
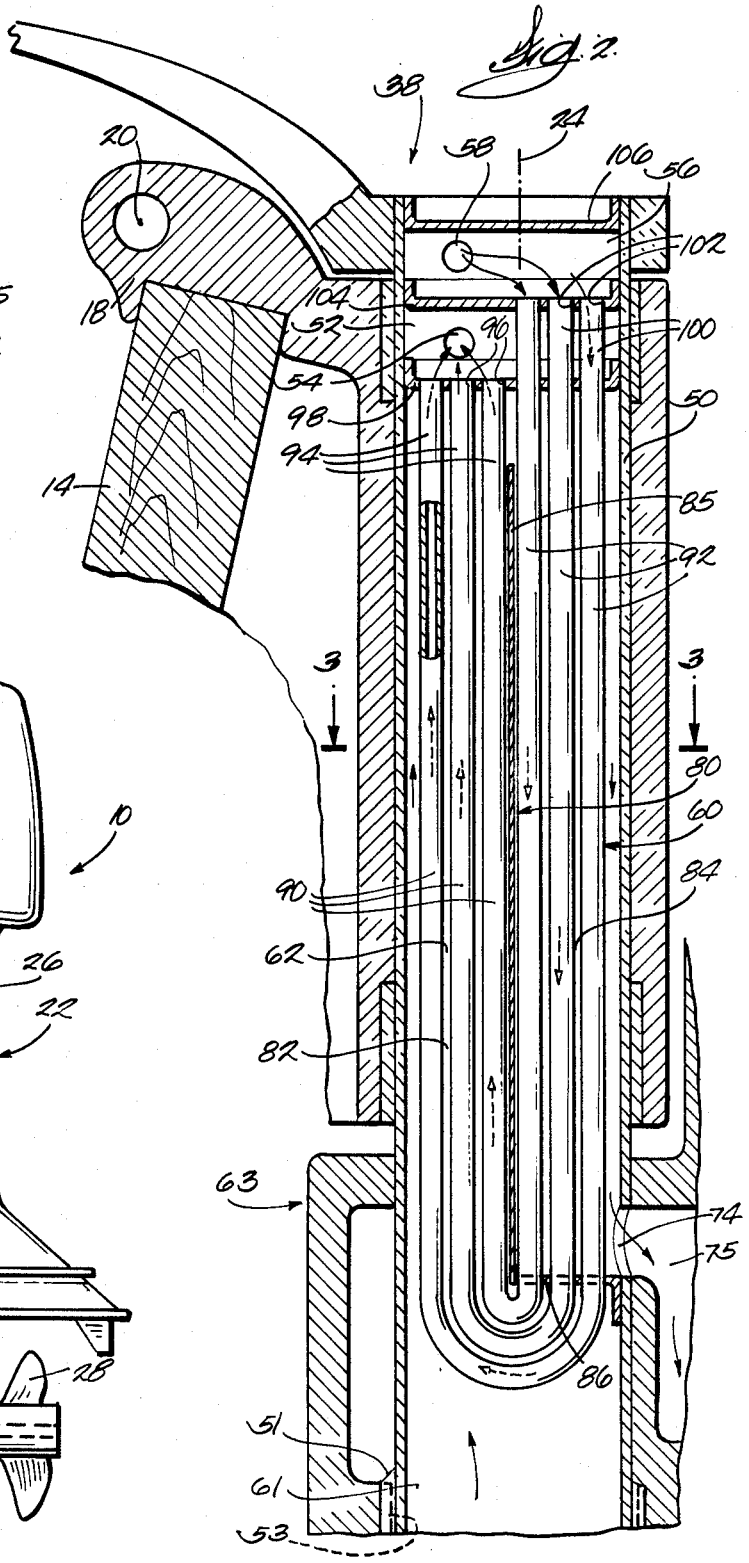
FIG. 2 is a vertical cross-sectional view of a portion of the device shown in FIG. 1.

The marine propulsion device 10 further comprises a fluid cooling kingpin assembly generally designated 38, which, as best shown in FIG. 2, is supported within a vertical bore of the swivel bracket 18 for rotation about the vertical steering axis 24, and includes a tubular pivot shaft 50 including a fluid passage adapted to communicate with the source of fluid to be cooled. While hydraulic fluid or other fluids could be coupled to the fluid cooling kingpin assembly 38, in the preferred embodiment shown, the source of fluid to be cooled is a conventional oil pump assembly 40 (shown in outline in FIG. 1) including a reservoir, coupled to assembly 38 by a supply line 42 and a return line 44. As illustrated in the drawings, the tubular pivot shaft 50 also includes a fluid outlet manifold 52 including an outlet fitting 54 extending externally of the tubular pivot shaft and adapted for connection to return line 44, and a fluid inlet manifold 56 including an inlet fitting 58 extending externally of the tubular pivot shaft and adapted for connection to the supply line 42.

While various arrangements could be utilized, in the preferred embodiment, the fluid passage adapted to communicate with the source of fluid to be cooled comprises a plurality of generally U-shaped tubes 60. Also, the tubular pivot shaft 50 also preferably includes therein a water passage 62, located adjacent the fluid passage or tubes 60. The water passage is further defined by an interior baffle 80, as described later below.

The lower end 61 of the tubular pivot shaft 50 protrudes through the exhaust housing 63 of the lower unit 26 and conventionally contains a spline 51 which mates with a gear 53 in the exhaust housing to preclude rotation. A nut 55 is attached to the end of the pivot shaft to hold the pivot shaft in place in fixed relation to the exhaust housing.

As best shown in FIG. 1, the lower unit exhaust housing 63 includes a water inlet 72 which is preferably located on the nose or leading edge of the lower unit, and which communicates with a water entry conduit 70 which, in turn, communicates with the open lower end 61 of the tubular pivot shaft 50. The exhaust housing 63 also includes a water outlet 78 which is located rearwardly of the water inlet 72, and which communicates with a water exit conduit 75. As best shown in FIG. 2, a lower portion of the pivot shaft 50 also includes an opening 72, which communicates with the water exit conduit 75.

As shown in FIGS. 2 and 3, the tubular pivot shaft 50 includes therein a baffle 80 having a main portion 85 which extends parallel to the axis of the pivot shaft 50 and which divides the water passage into an inlet water chamber 82 communicating with the water entry conduit 70 and an outlet water chamber 84 which comminicates with the water exit conduit 75. The baffle 80 includes a semi-circular end portion 86 which extends transversely from the main portion 85 and is connected to the inner wall of the shaft 50 below the opening 74 (see FIG. 2), to further define the outlet water chamber 84, and to force the water entering the inlet water conduit 70 from the water inlet 72 to flow serially through the inlet water chamber 82, the outlet water chamber 84, the water exit conduit 75, and the water outlet 78.

As best shown in FIG. 2, the legs, designated 90, of the U-shaped tubes contained within the inlet water chamber 82 are connected and communicate with the fluid outlet manifold 52, and the legs 92 of the U-shaped tubes extending within the outlet water chamber 84 are connected to and communicate with the fluid inlet manifold 56. Thus, forward motion of the lower unit results in a flow of water serially through the inlet and outlet water chambers adjacent the U-shaped tube legs 90 and 92, respectively, thus cooling the fluid in the U-shaped tubes contained within the tubular pivot shaft 50. Of course, the water flow in the water passage could also be supplied by a suitable water pump arrangement.

As shown in FIG. 2, the open ends 94 of the legs 90 are connected to and communicate with openings 96 in the lower wall 98 of the fluid outlet manifold 52. The legs 92 of the U-shaped tubes 60 pass through respective openings or perforations in the end portion 86 of baffle 80, and through perforations in the lower manifold wall 98, while the open ends 100 of the legs 92 are connected to and communicate with openings 102 in the lower wall 104 of the fluid inlet manifold 56. The fluid inlet manifold 56 includes an upper wall 106, while the lower wall 104 also forms the upper wall of the fluid outlet manifold 52. As illustrated, the outlet and inlet manifolds 52 and 56 are located adjacent each other at one end of the tubular pivot shaft while the U-shaped tubes each have a pair of legs and a middle portion which extend toward the opposite end of the pivot shaft. Also, as shown, the legs of the U-shaped tubes 60 extend along a major portion of the length of the tubular pivot shaft. The tubular pivot shaft 50, U-shaped tubes 60 and manifolds 52 and 56 may be welded or braised or otherwise suitably secured together as a sealed unit.

While dimensions are not critical, it should be appreciated that the tubular pivot shaft has an inside opening diameter which should accommodate a fluid passage and a water passage adjacent the fluid passage, and this provides an effective space-saving method of cooling oil circulated by a conventional oil pump assembly of a marine propulsion device. Also, while the illustrated embodiment has disclosed an arrangement to cool oil, it should be appreciated that the invention provides a fluid cooling kingpin which can be utilized for cooling of hydraulic fluid, oil or any other fluid. It should be understood that the fluid passage can in alternative embodiments, have any suitable construction enabling cooling of the fluid in the fluid passage by water passing through the water passage in the tubular pivot shaft.

Various features and advantages of the invention are set forth in the following claims.

I claim:

1. A marine propulsion device comprising a power head having an engine, a lower unit which carries said engine, said lower unit including a rotatably mounted propeller and a drive shaft housed within said lower unit and operatively coupled to said engine and to said propeller, a swivel bracket adapted for mounting to a transom bracket for affording vertical tilting movement of said swivel bracket about a generally horizontal axis, said swivel bracket having a generally vertical bore, and a tubular pivot shaft connected to said lower unit and supported within said vertical bore for rotation about a generally vertical steering axis, and including therein a fluid passage adapted to communicate with a source of fluid to be cooled, and a coolant passage adapted to communicate with a source of coolant.

2. A marine propulsion device in accordance with claim 1 wherein said coolant passage comprises a water passage located adjacent said fluid passage and adapted to communicate with a flow of water to cool the fluid in said fluid passage.

3. A marine propulsion device comprising a power head having an engine, a lower unit which carries said engine, said lower unit including a rotatably mounted propeller, a drive shaft housed within said lower unit and operatively coupled to said engine and to said propeller, a water entry conduit, a water inlet connected to said water entry conduit, a water exit conduit, and a water outlet connected to said water exit conduit, a swivel bracket adapted for mounting to a transom bracket for affording vertical tilting movement of said swivel bracket about a generally horizontal axis, said swivel bracket having a generally vertical bore, and a tubular pivot shaft connected to said lower unit and supported within said vertical bore for rotation about a generally vertical steering axis, and including therein a fluid passage adapted to communicate with a source of fluid to be cooled, and a water passage located adjacent said fluid passage and communicating with said lower unit water entry and exit conduits so that forward motion of said lower unit results in a flow of water through said water passage to cool the fluid in said fluid passage.

4. A marine propulsion device in accordance with claim 3, wherein said lower unit includes a leading edge and wherein said water inlet is located on said leading edge of said lower unit, and wherein said lower unit water outlet is located rearwardly of said water inlet.

5. A marine propulsion device in accordance with claim 3, wherein said tubular pivot shaft includes therein a fluid inlet manifold adapted to receive the fluid to be cooled and a fluid outlet manifold adapted to receive the fluid after cooling thereof, and wherein said fluid passage communicates with said fluid inlet and outlet manifolds.

6. A marine propulsion device in accordance with claim 5, wherein said fluid inlet manifold includes an inlet fitting extending externally of said tubular pivot shaft and adapted for connection to a supply line of fluid to be cooled, and wherein said fluid outlet manifold includes an outlet fitting extending externally of said tubular pivot shaft and adapted for connection to a return line of the fluid to be cooled.

7. A marine propulsion device in accordance with claim 5, wherein said inlet and outlet manifolds are located adjacent each other at one end of said tubular pivot shaft, and wherein said fluid passage comprises a generally U-shaped tube with a pair of legs and a middle portion which extends toward the opposite end of said tubular pivot shaft.

8. A marine propulsion device in accordance with claim 7, wherein said tubular pivot shaft includes therein a baffle which divides said water passage into an inlet water chamber communicating with said lower unit water entry conduit, and an outlet chamber communicating with said inlet water chamber and with said lower unit water exit conduit, and wherein one leg of said U-shaped tube extends within said inlet water chamber and the other leg of said U-shaped tube extends within said outlet water chamber, whereby forward motion of said lower unit results in a flow of water serially through said inlet water chamber and said outlet water chamber to cool the fluid in said U-shaped tube.

9. A marine propulsion device in accordance with claim 8, wherein the leg of said U-shaped tube extending within said inlet water chamber is connected to said fluid inlet manifold, and the leg of said U-shaped tube contained within said outlet water chamber is connected to said fluid outlet manifold.

10. A marine propulsion device in accordance with claim 8, wherein said baffle and said legs of said U-shaped tube extend within said tubular pivot shaft generally parallel to the axis of said tubular pivot shaft and extend along a major portion of the length of said tubular pivot shaft.

11. A marine propulsion device in accordance with claim 8, including a plurality of U-shaped tubes each having a pair of legs with one leg communicating with said fluid inlet manifold and extending through said water inlet chamber within said tubular pivot shaft and with the other leg communicating with said fluid outlet manifold and extending through said water outlet chamber of said tubular pivot shaft.

12. A marine propulsion device in accordance with claim 11, further comprising an oil pump assembly including a reservoir; and wherein said fluid to be cooled comprises oil to be utilized in said oil pump assembly.

13. A fluid cooling kingpin assembly adapted for use with a marine propulsion device including a power head having an engine and lower unit which carries said engine and a rotatably mounted propeller, said assembly comprising a swivel bracket adapted for mounting to a transom bracket for affording vertical tilting movement of said swivel bracket and the lower unit about a generally horizontal axis, said swivel bracket having a generally vertical bore, and a tubular pivot shaft mounted within said vertical bore for support of a lower unit and rotation of the lower unit about a generally vertical steering axis, said tubular pivot shaft including therein a fluid passage adapted to communicate with a source of fluid to be cooled, and a coolant passage adapted to communicate with a source of coolant.

14. A fluid cooling kingpin assembly in accordance with claim 13 wherein said coolant passage comrpises a water passage located adjacent said fluid passage and adapted to communicate with a flow of water to cool the fluid in said fluid passage.

15. A fluid cooling kingpin adapted for use with a marine propulsion device including a power head having an engine and lower unit which carries the engine and a rotatably mounted propeller, and a swivel bracket adapted for mounting to a transom bracket adapted for mounting to a transom bracket for affording vertical tilting movement of the swivel bracket and the lower unit about a generally horizontal axis, the swivel bracket having a generally vertical bore, said fluid cooling kingpin comprising a tubular pivot shaft mounted within the swivel bracket vertical bore for rotation and support of the lower unit about a generally vertical steering axis, said tubular pivot shaft including therein a fluid passage adapted to communicate with a source of fluid to be cooled, and a coolant passage adapted to communicate with a source of coolant.

16. A fluid cooling kingpin in accordance with claim 15 wherein said coolant passage comprises a water passage located adjacent said fluid passage and adpated to communicate with a flow of water to cool the fluid in said fluid passage.

* * * * *